US005417079A

United States Patent [19]

Rudick et al.

[11] Patent Number: 5,417,079

[45] Date of Patent: May 23, 1995

[54] MODULAR REFRIGERATION APPARATUS

[75] Inventors: Arthur G. Rudick, Marietta; Shaun B. Gatipon, Smyrna; Howard W. Wachenheim, Ball Ground, all of Ga.

[73] Assignee: The Coca-Cola Company, Atlanta, Ga.

[21] Appl. No.: 274,795

[22] Filed: Jul. 14, 1994

Related U.S. Application Data

[62] Division of Ser. No. 907,501, Jul. 1, 1992, Pat. No. 5,347,827.

[51] Int. Cl.[6] ..... F25D 19/00; F25D 11/00; F25D 15/00; A47F 3/04

[52] U.S. Cl. ..... 62/253; 62/237; 62/255; 62/440; 62/448; 62/450

[58] Field of Search ..... 62/453, 253, 255, 440, 62/448, 237, 450

[56] References Cited

U.S. PATENT DOCUMENTS

| | | | |
|---|---|---|---|
| 2,506,448 | 5/1950 | Gregor | 62/237 X |
| 2,635,938 | 4/1953 | Whitney et al. . | |
| 2,672,029 | 3/1954 | Saunders . | |
| 2,673,455 | 3/1954 | Brinkoeter . | |
| 2,675,901 | 4/1954 | Childers . | |
| 3,019,620 | 2/1962 | Costantini et al. . | |
| 3,063,255 | 11/1962 | Fanick, Jr. et al. | 62/256 |
| 3,156,102 | 11/1964 | Costantini et al . | |
| 3,206,943 | 9/1965 | Rice et al. | 62/448 |
| 3,299,664 | 1/1967 | Booth | 62/418 |
| 3,366,432 | 1/1968 | Carmer | 62/255 X |
| 3,712,078 | 1/1973 | Maynard et al. | 62/237 X |
| 3,933,006 | 1/1976 | South | 62/78 X |
| 4,299,092 | 11/1981 | Ibrahim | 62/418 X |
| 4,509,339 | 4/1985 | Mehlan et al. | 62/450 |
| 4,668,028 | 5/1987 | Kimoto . | |

FOREIGN PATENT DOCUMENTS 2227302 7/1990 United Kingdom .

*Primary Examiner*—Christopher B. Kilner

[57] ABSTRACT

A modular refrigeration apparatus containing a cabinet with a front opening and divided into lower and upper portions, for separately receiving a plurality of removable modular units, said removable modular units including one of a selected plurality of interchangeable storage units and a universal refrigeration unit. A selected one of the plurality of interchangeable storage units is positioned within the upper portion of the cabinet for storing a plurality of containers. The refrigeration unit is positioned within the lower portion of the cabinet and in communication with the upper portion for cooling the entire interior of the cabinet. The cabinet is designed so that the interchangeable storage units and refrigeration unit can be respectfully removed or inserted from the cabinet without affecting the other units.

4 Claims, 6 Drawing Sheets

MODULAR REFRIGERATION APPARATUS

This application is divisional of application Ser. No. 07/907,501, on Jul. 1, 1992, now U.S. Pat. No. 5,347,827, the entire contents of which are hereby incorporated by reference.

BACKGROUND OF THE INVENTION

The present invention relates to a refrigerated cabinet for storing beverage containers and other food items, and more particularly, to a cabinet for housing a plurality of readily interchangeable and independent modular elements which collectively define a refrigeration cabinet having multiple uses.

Beverage containers are displayed and sold in a variety of different types of refrigerated self-serve display cabinets and coin-operated vending machines. The sales environment in which the machine will be used most times determines the necessary attributes of a particular refrigerated cabinet. For example, a glass door merchandiser may be chosen to sell items inside a business, but would not be practical for vending items outside the business where a closed coin-operated merchandiser would be a better choice.

However, conventional refrigerated cabinets are not easily convertible from one type of merchandiser to another. For example, if a vendor purchases a closed vending machine but later discovers the need for a display type refrigerated cabinet, there is presently no way of economically and conveniently converting that machine. This is due in part to differences in the refrigeration systems provided by the two diverse types of vendors. This inability to convert merchandisers prohibits vendors from utilizing more effective methods for selling a product. Further, a vendor's purchase of a plurality of different types of cabinets causes expense and inventory problems.

SUMMARY OF THE INVENTION

It is a primary object of this invention to provide a modular refrigeration apparatus with a cabinet having a front opening and divided into refrigerated and unrefrigerated portions for housing a plurality of removable modular units, the removable modular units including one of a selected plurality of interchangeable storage units and substantially the same refrigeration unit for use with either storage unit.

It is a further object of the invention to provide a modular refrigeration apparatus in which a plurality of interchangeable storage units and a refrigeration unit can be easily removed or inserted from within a cabinet without affecting the other units.

It is a further object of the present invention to provide a modular refrigeration apparatus in which one of a plurality of interchangeable storage units includes a vending unit for storing and dispensing a plurality of containers having a front panel which attaches to and seals the front opening of the cabinet, the front panel having a product selection mechanism for enabling a customer to choose the product to be dispensed and a vending mechanism for ejecting the selected container.

It is a further object of the present invention to provide an interchangeable storage unit having a transparent door, the transparent door unit having a transparent door pivotally attached to a frame for mounting to the cabinet across the front opening for sealing the cabinet and an air distribution plenum disposed at the rear interior of the cabinet with slots to facilitate circulation of cool air for cooling the contents of the cabinet.

It is the further object of the present invention to provide a modular refrigeration apparatus having a condenser, compressor, evaporator, first fan and second fan capable of easy installation and removal from the cabinet without affecting the storage unit.

A modular refrigeration apparatus in accordance with the present invention includes a cabinet having a front opening and divided into refrigerated and unrefrigerated portions, for separately receiving a plurality of removable modular units, said removable modular units including one of a selected plurality of interchangeable storage units and a universal refrigeration unit useable with any one of the storage units. A selected one of the plurality of interchangeable storage units is positioned within the refrigerated portion of the cabinet for storing a plurality of containers. The refrigeration unit is positioned within the unrefrigerated portion of the cabinet and in communication with the refrigerated portion for cooling the entire interior of the cabinet. The cabinet is designed so that the interchangeable storage units and the universal refrigeration unit can be respectfully removed or inserted from the cabinet without affecting the other units.

Further objects, features and other aspects of the invention will be understood from the following detailed description of the preferred embodiments of the disclosed invention referring to the detailed drawings given below.

DETAILED DESCRIPTION OF THE PREFERRED EMBODIMENT

The present invention is generally directed to a cabinet and readily interchangeable storage units and refrigeration unit in a modular refrigeration apparatus as illustrated and described below.

Figure 1:
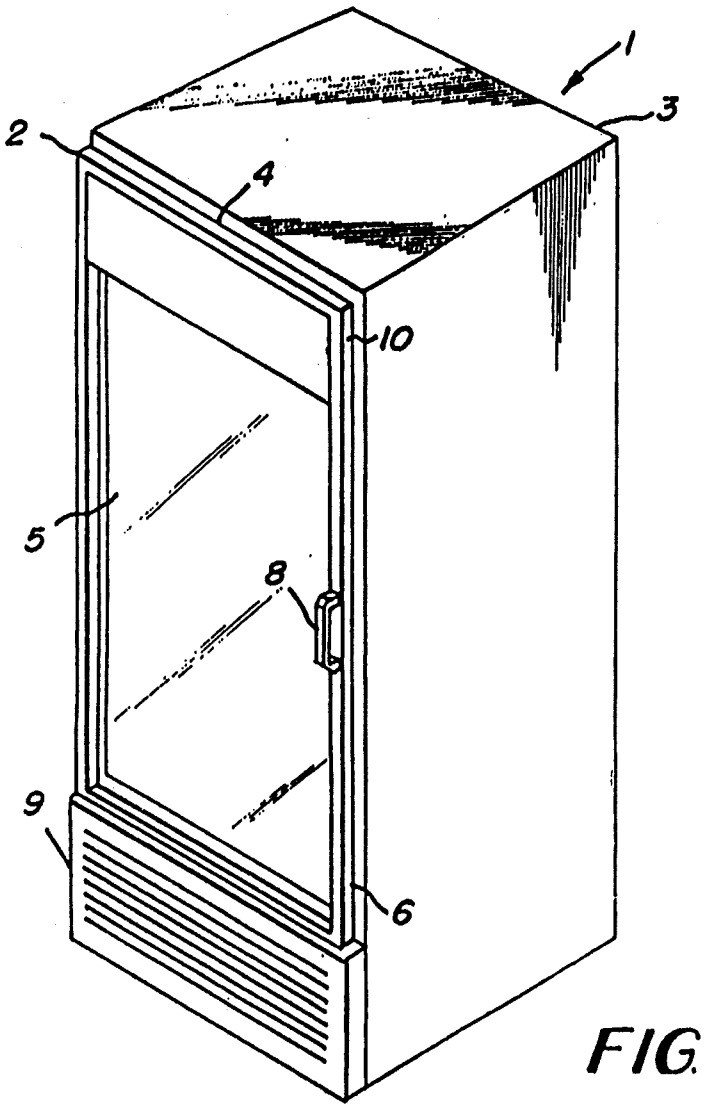
FIG. 1 is an isometric view of the exterior of the modular refrigeration apparatus of the present invention with a transparent door storage unit in place.

With reference to FIG. 1, the exterior of a first embodiment of a modular refrigeration apparatus according to the present invention is shown. This embodiment is directed to a modular refrigeration apparatus having a transparent door storage unit 2. The modular refrigeration apparatus includes a box-shaped cabinet 3 having a top, bottom, and three sides with a central front opening 4 for receiving the modular units. In this embodiment, the transparent door storage unit 2 is attached to the upper portion of the cabinet 3 and defines the front wall of the refrigeration apparatus. The transparent door storage unit 2 has a transparent panel 5 suspended in a frame 6 and pivotally mounted on a door jamb (not shown) surrounding the central front opening 4. A handle 8 is affixed to the exterior front edge of the frame 6 to facilitate easy manual opening of the door unit. A removable grill 9 completes the remaining and lower portion of the front wall.

Product is supported on spaced shelves (not shown) within storage unit 2.

Figure 2:
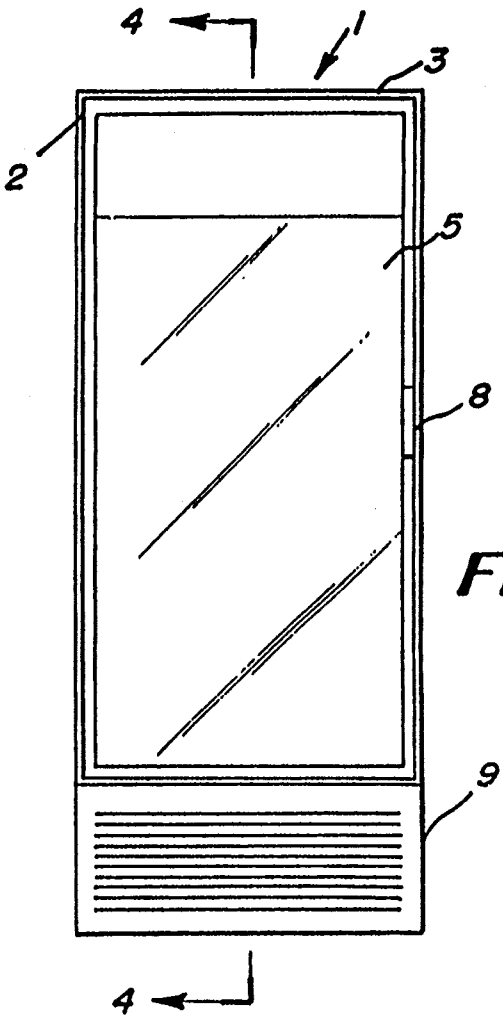
FIG. 2 is a front elevational view of the exterior of the modular refrigeration apparatus of FIG. 1.

FIG. 2 is a front elevational view of the modular refrigeration apparatus 1 with a transparent door storage unit 2. The panel 5 is substantially transparent for allowing customers to see the contents of the cabinet without opening the door.

Figure 3:
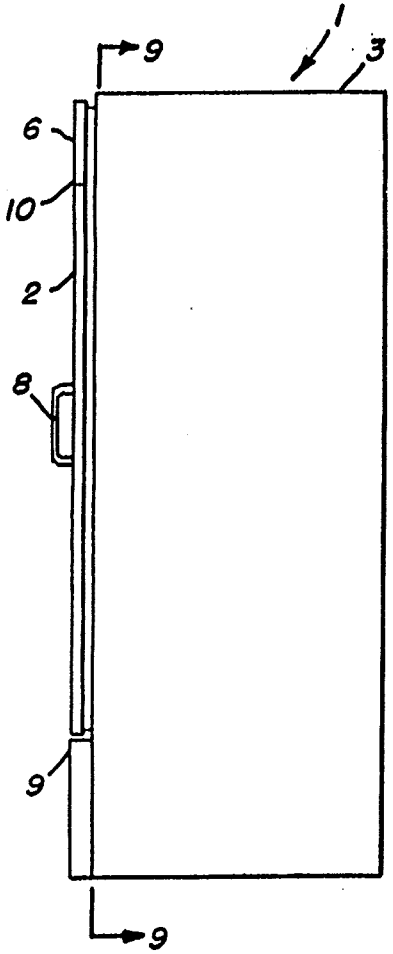
FIG. 3 is a side elevational view of the exterior of the modular refrigeration apparatus of FIG. 1.

FIG. 3 is a side elevational view of the modular refrigeration apparatus of FIG. 1. There the transparent door storage unit 2 is shown as abutting the edges of the central front opening 4 for creating a sealed storage unit. A compliant seal 10 is attached to the entire peripheral interior edge of the casing 6 of the transparent door storage unit 2 and between the front edge of the cabinet 3 and the frame 6. When closed, the compliant seal 10 forms an air-tight seal between the periphery of the casing and the cabinet's front edge to seal the refrigerated portion of the cabinet 3.

Figure 4:
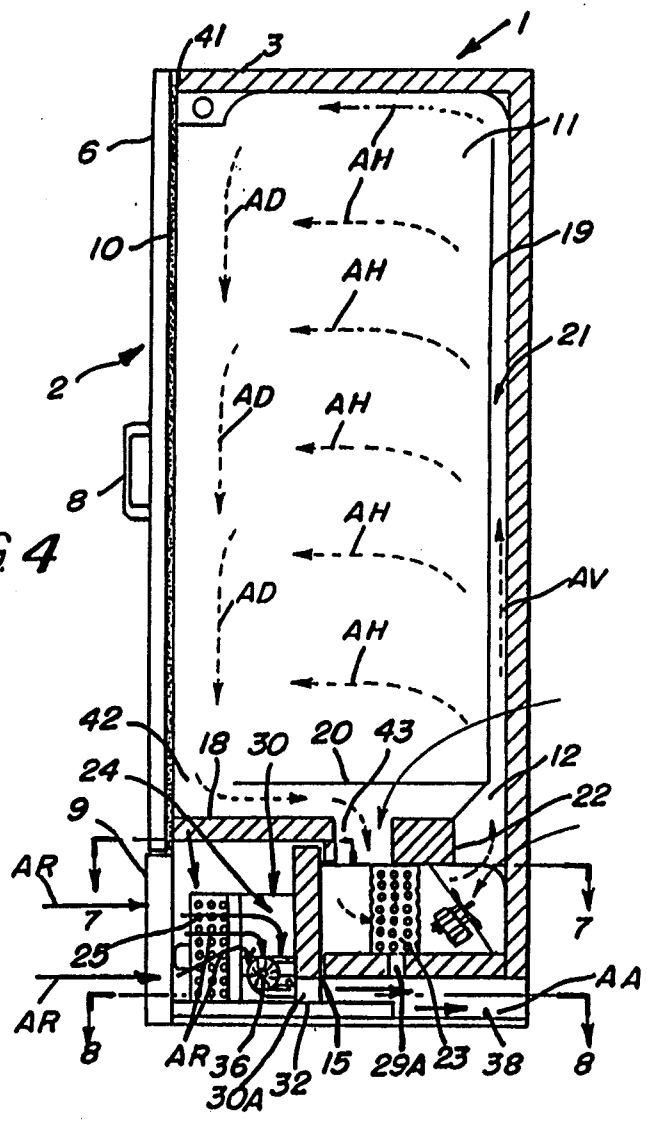
FIG. 4 is a cross sectional view of the interior of the modular refrigeration apparatus along line 4—4 of FIG. 2.

FIG. 4 is a cross sectional view along 4—4 of FIG. 2 showing the interior of the modular refrigeration apparatus. The cabinet 3 is divided into a refrigerated portion 11 and an unrefrigerated portion 12. The refrigerated portion 11 contains the transparent door storage unit 2 and its contents. The unrefrigerated portion houses the refrigeration unit. The refrigerated portion 11 is partially divided from the unrefrigerated portion 12 by a divider 18.

The transparent door storage unit 2 includes a modular transparent door unit 2 and an air distribution system for directing the circular flow of cool air within the refrigerated portion 11 of the cabinet 3.

The air distribution system includes a vertically disposed, ventilated, false back wall 19 which is used to initiate the circular flow of cool air within the upper portion 11 of the cabinet 3, and an air deflection plate 20 extending horizontally therefrom. The ventilated false back 19 is spaced apart from, and substantially parallel to, the rear interior wall of the refrigerated portion 11 of the cabinet 3 creating an air distribution plenum 21 therebetween. The air distribution system also includes a base plate assembly 22 for supporting the false back 19 and air deflection plate 20. The base plate assembly 22 supports the false back and abuts the refrigeration unit 15 forming two distinct air flow channels to and from the refrigeration unit 15.

Figure 6:
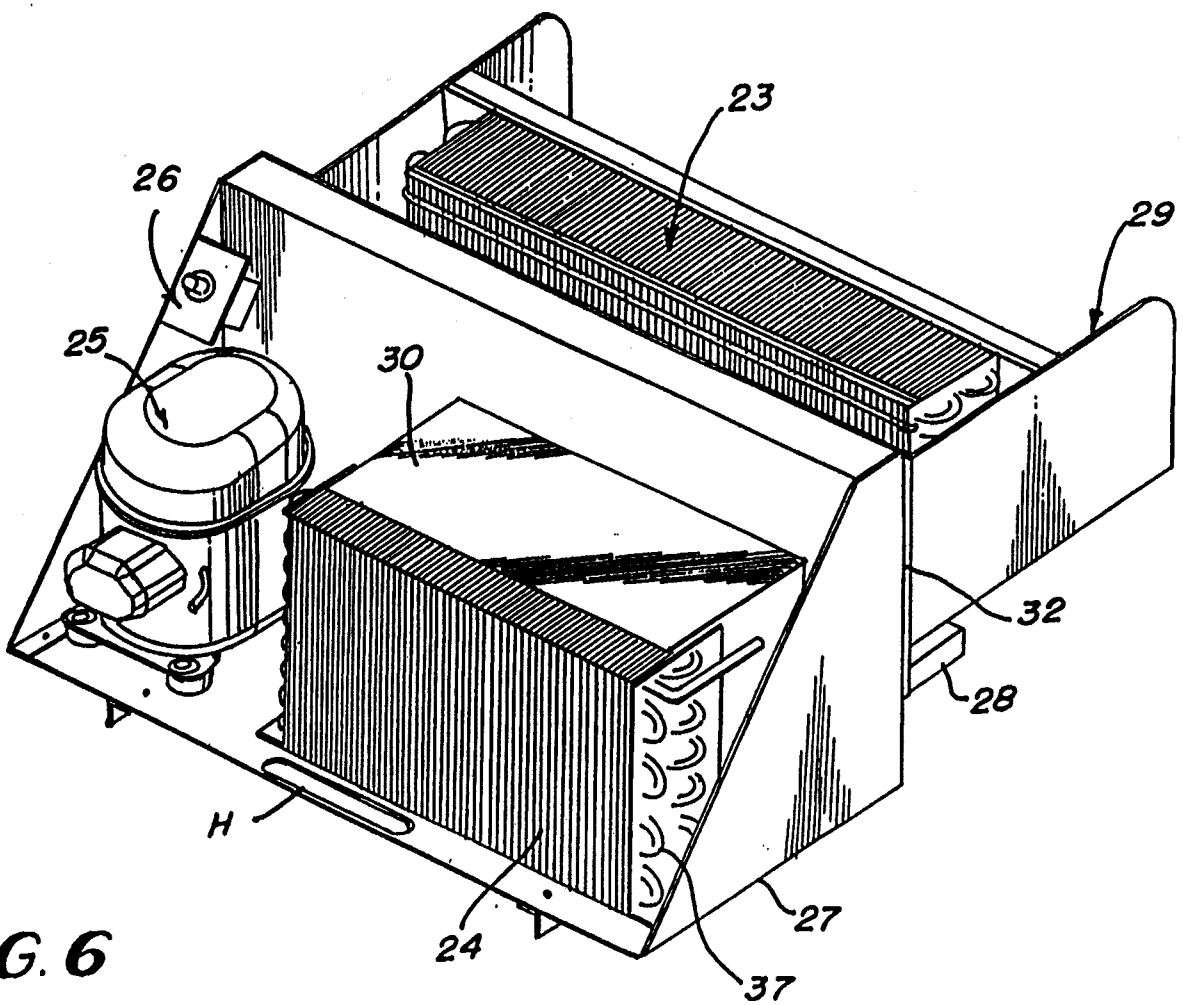
FIG. 6 is an enlarged isometric view of the refrigeration unit of FIG. 5.

The refrigeration unit 15 is shown in detail in FIGS. 5–8. With reference to FIG. 6, the refrigeration unit 15 includes an evaporator 23, a condenser 24, a compressor 25 and a temperature controller 26. The components of the refrigeration unit 15 are collectively arranged on a base 27. The base 27 is supported on a plurality of skids 28 affixed to the bottom of the base 27. The temperature controller 26, compressor 25, and condenser 24 are contained in the front portion of the base 27. The condenser 24 is enclosed within a condenser shroud 30 having a rear exhaust slot 30A (See FIG. 5). The front portion and rear portion of the refrigeration unit 15 are separated by a central partition 32. The evaporator 23 is contained within an evaporator tray 29, which collects condensed water from the cooled air as it passes over the evaporator 23. The condensed water drains out of evaporator pan 29 through a hole (not shown) in the bottom of the pan. The hole in the bottom of pan 29 aligns with hole 29A located in the bottom panel in the lower portion of the unit. The condensed water continues through hole 29A then drains into a shallow pan (not shown) located on the floor of condenser exhaust channel 38. Warm air from the condenser evaporates the water. A handle H assists in easily moving the refrigeration unit 15 in or out of the cabinet 3.

Air AR enters the condenser 24 through the removable front grill 9. Air AR flows through the condenser 24 passing rover the coil 37 which runs throughout the condenser 24. The condenser exhaust is then pulled into the squirrel cage fan impeller 36A. The shroud 30 assists in directing the condenser exhaust into the fan 36A. The Squirrel cage fan impeller 36A then blows the condenser exhaust through slot "30A" into channel "38" then out into the atmosphere With particular reference to FIG. 5, the refrigeration unit 15 is shown removed from the cabinet 3. The refrigeration unit 15 is supported in the unrefrigerated portion 12 of the cabinet 3 on a plurality of the guide rails 31 which are aligned with the skids 28. The refrigeration unit 15 can be easily accessed by removing the removable grill 9 and sliding the refrigeration unit 15 out of the cabinet 3 on the guide rails. This enables the refrigeration unit 15 to be easily repaired or replaced without disturbing the remaining portions of the cabinet 3 or storage modules. The central partition 32 includes a second compliant seal 33 on the evaporator side of the partition that abuts a shelf in the cabinet 3 for sealing the refrigeration unit 3 in communication with the refrigerated portion 11 of the cabinet 3.

Figure 7:
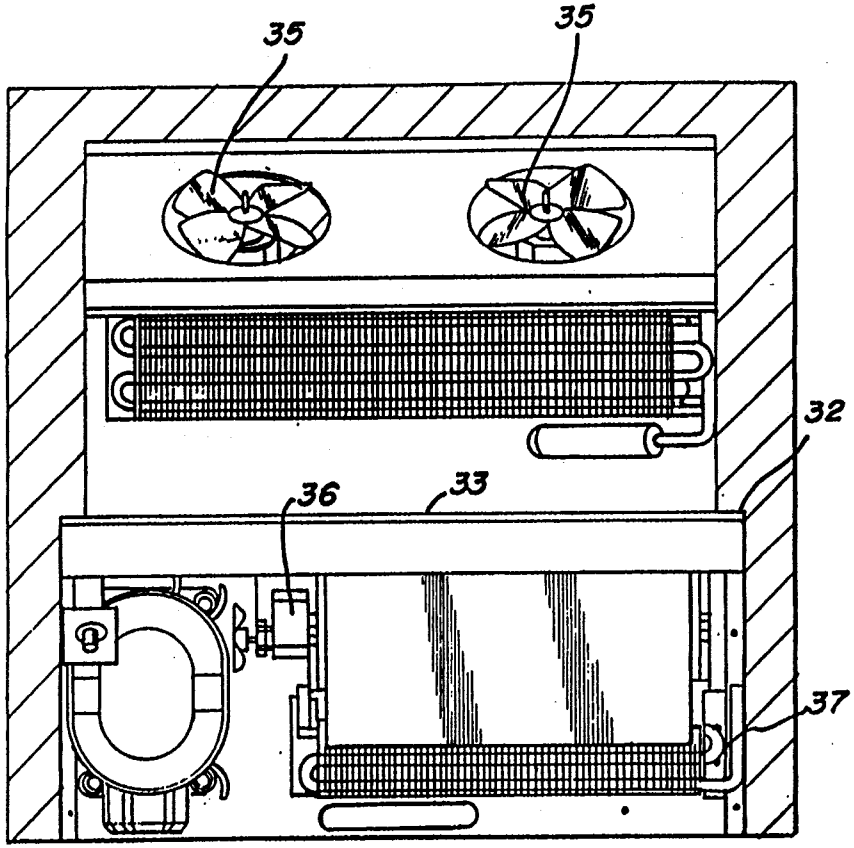
FIG. 7 is a cross-sectional view of the modular refrigeration unit as shown in FIG. 4 along line 7—7.

FIG. 7 is a cross sectional view along line 7—7 of FIG. 4 of the refrigeration unit 15. The refrigeration unit 15 also contains an evaporator fan 35 for circulating air within the interior of the apparatus, and a condenser fan with a motor 361 and a squirrel cage impeller 36A for exhausting warm air from cooling coils 37 of the condenser 24 through rear exhaust slot 30A.

Figure 8:
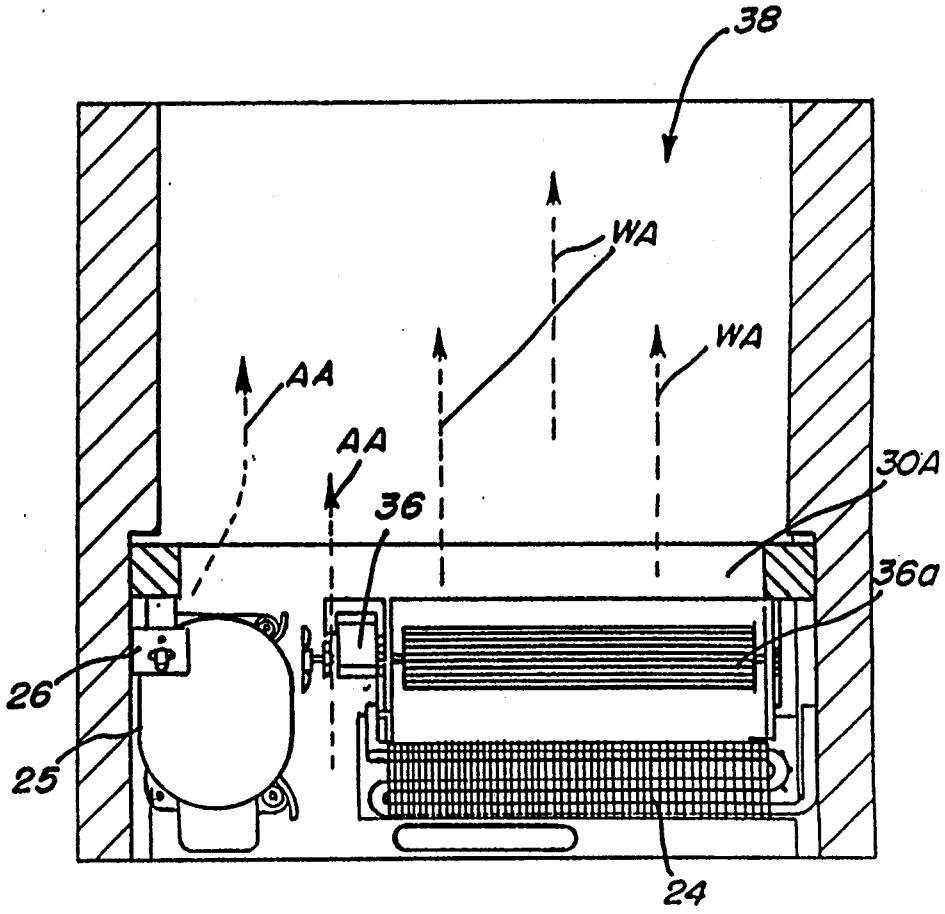
FIG. 8 is an upper cross sectional view of the modular refrigeration unit as shown in FIG. 4 along line 8—8.
Figure 5:
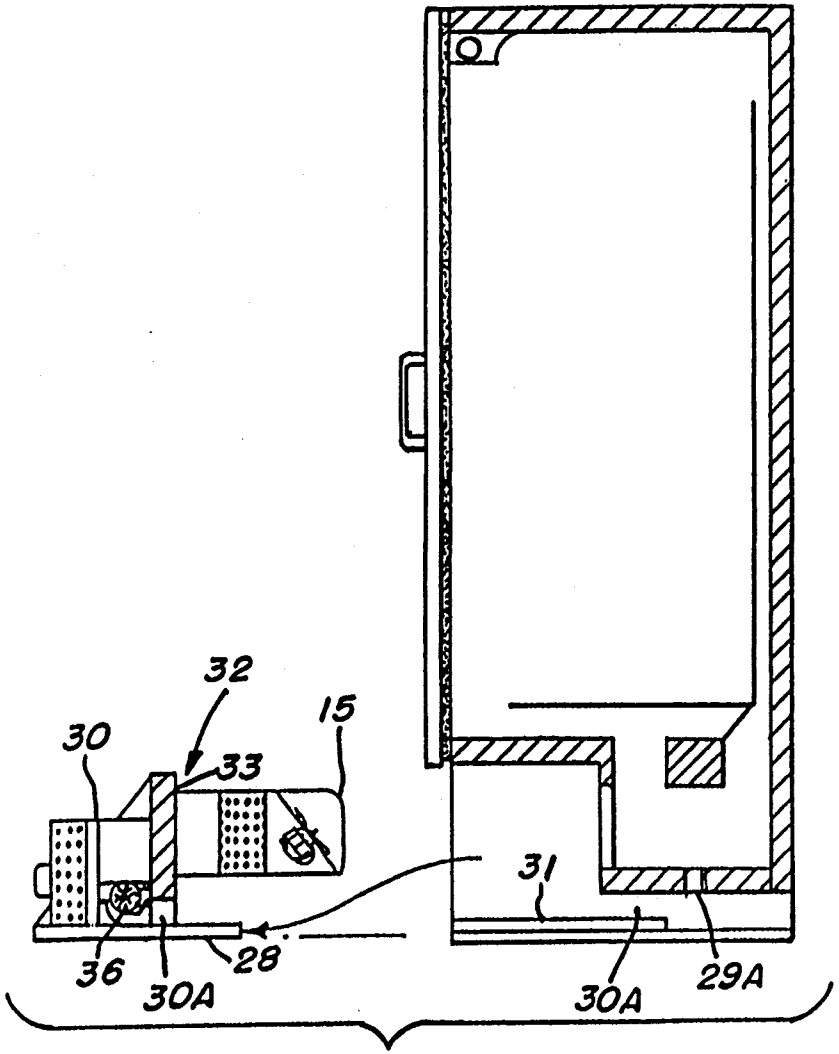
FIG. 5 is a cross sectional view of the interior of the modular refrigeration apparatus also along 4—4 of FIG. 2 with the modular refrigeration unit removed.

FIG. 8 shows a cross section of the apparatus along line 8—8 of FIG. 4. The condenser fan including motor 36 and squirrel cage impeller 36A exhausts the warm air WA via a condenser exhaust channel 38. The condenser fan squirrel cage impeller draws air from around coil 37 and through exhaust slot 24C and condenser exhaust channel 38. The air WA rapidly moving through the right side of the channel 38 creates an aspiration effect drawing air AA into the left portion of the channel. The air AA drawn into the left portion flows past the compressor 25, providing cooling which prevents the compressor from overheating. The squirrel cage impeller 36A creates this rapid air flow.

Figure 9:
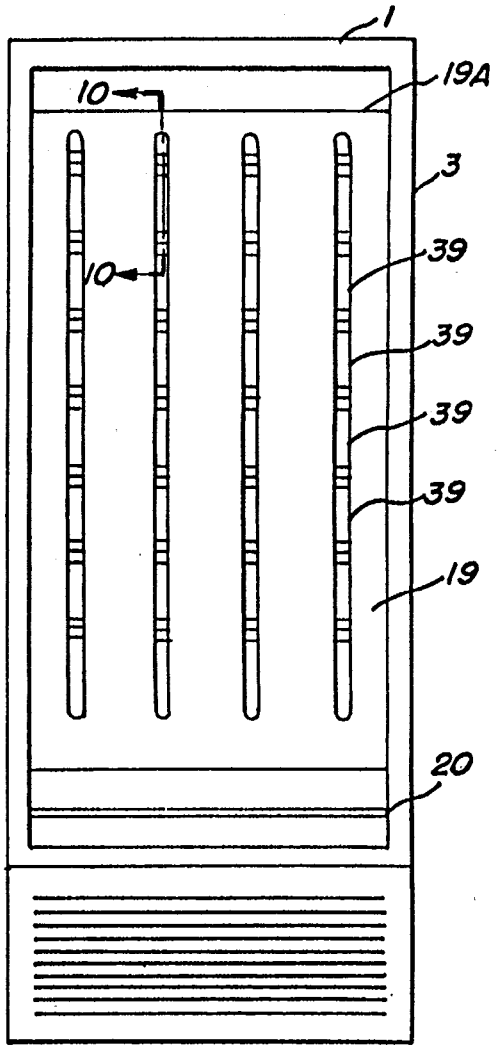
FIG. 9 is a front elevational view of the modular refrigeration apparatus with the door removed showing air directing slots in the distribution plenum.

A front elevational view of the ventilated false back 19 is shown in FIG. 9. The ventilated false back 19 includes a plurality of slots 39 vertically disposed in horizontally spaced columns. These slots 39 direct a portion of the air flow through the air distribution plenum 21 into the interior of the cabinet 3. A space exists between the upper edge 19A of the false back 19 and the upper interior wall of the cabinet 3 for allowing any residual air flow not directed through the slots 39 to flow into the central portion of cabinet 3.

Figure 10:
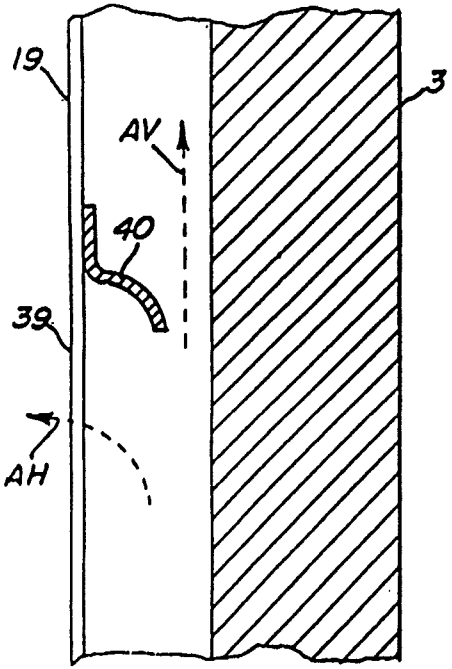
FIG. 10 is a cross sectional view of the modular refrigeration apparatus of FIG. 9 along line 10—10 of FIG. 9 highlighting a portion of the distribution plenum.

As shown in FIG. 10, slots 39 are separated by curved air directors or baffles 40 positioned adjacent thereto for directing a portion of the air flow through the air distribution plenum 21 into the interior of the cabinet 3 while the remainder of the air flow continues through the air distribution plenum 21. Each air director 40 is curved so as to direct air flow AH toward the front of the cabinet 3 (See FIG. 4).

The airflow circulation within the cabinet 3 is illustrated in FIG. 4. The airflow begins with the evaporator fans 35 (FIG. 7) pushing cool air from the evaporator 23 up the back interior wall of the cabinet 3 into the air distribution plenum 21 (See arrow AV). Air AV traveling into the air distribution plenum 21 is directed by the air directors 40 through the slots 39 and enters the interior of the cabinet creating a plurality of air currents AH. These air currents AH flow over products supported on shelves (not shown) to cool the same to the desired storage temperature. Any residual cool air enters the cabinet from the air distribution plenum 21 through the space between the top edge 19A of the false back 19 and the upper interior wall of the cabinet 3. The air flow along the upper interior surface of the cabinet 3 is directed down along the interior surface of the transparent panel 5 by an air deflector 41. As the cool air contacts the interior of the transparent panel 5, it is directed downward (See arrows AD) through an intake 42 defined between the transparent door storage unit 2 and the front end of the air deflection plate 20. Any air not entering the intake 42 is redirected by the air deflection plate 20 back into the interior of the upper portion 11. Air ingested through the intake 42 is recycled in the refrigeration unit 15 through an evaporator inlet 43 and into the evaporator 23. The air is cooled while in the refrigeration unit by the evaporator 23. Once cooled, the evaporator fan 35 draws the air up and back into plenum 21 of cabinet 3.

Figure 11:
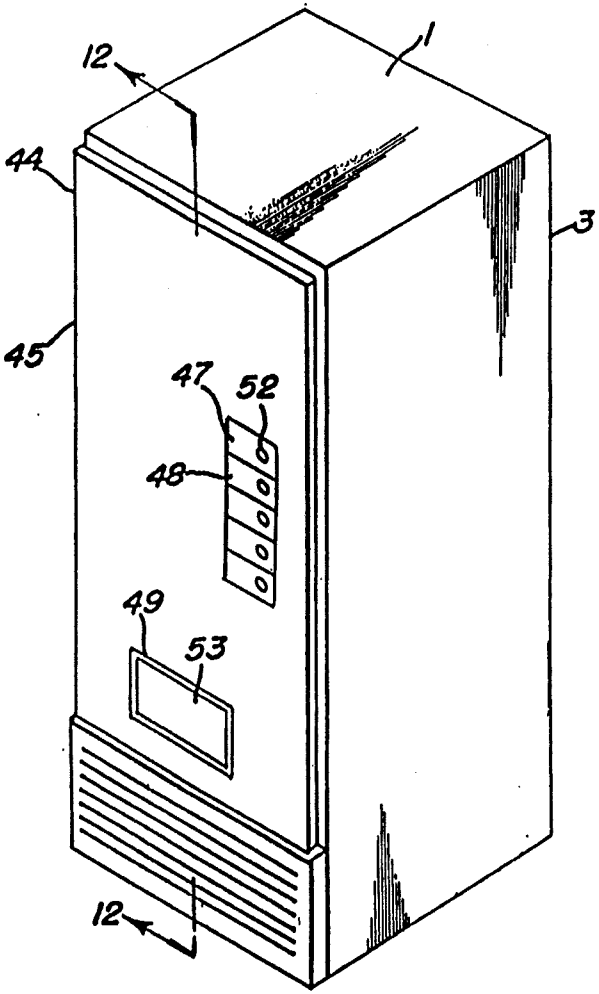
FIG. 11 is an isometric view of the exterior of the modular refrigeration apparatus of the present invention with a modular vendor unit substituted for the transparent door unit.

FIG. 11 shows a modular refrigeration apparatus 1 with a cabinet 3 and a modular vending unit 44. Similar to the transparent door storage unit 2, the modular vending unit 44 includes the ventilated false back 19. However, the air deflection plate 20 may be removed. Unit 44 is positioned within the refrigerated portion 11 and against the front central opening of the cabinet 3.

The modular vending unit 44 differs from the transparent door storage unit 2 in that the front is opaque or translucent. The modular vending unit 44 is composed of a front panel 45, a plurality of storage racks 46, a product selection device 47 attached to the front panel 45, and a vending mechanism 48 for causing a container to be ejected from a selected one of the storage racks 46 and out an aperture 49 in front of the panel 45.

Figure 12:
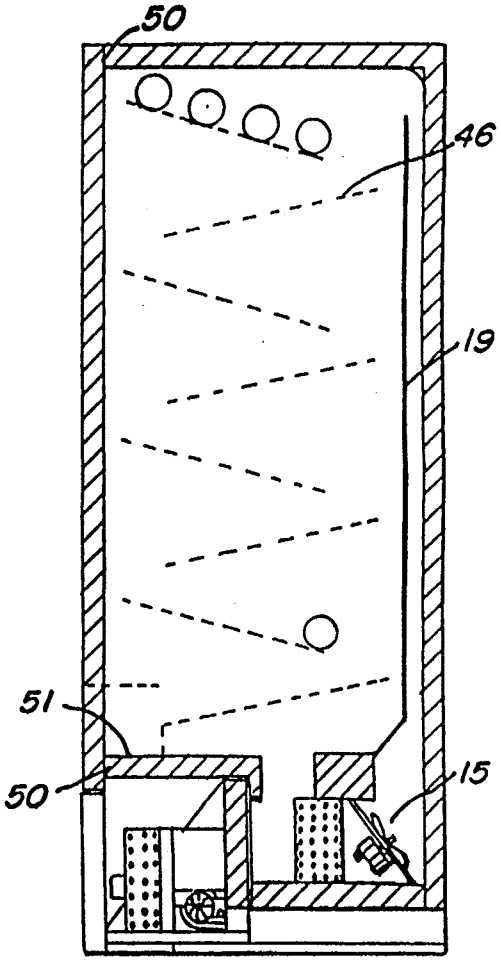
FIG. 12 is a cross-sectional view of the modular refrigeration apparatus with a modular vendor unit along line 12—12 of FIG. 11.

As illustrated in FIG. 12, storage racks 41 may comprise slant shelves defining side-by-side serpentine paths as are known in the art. Each serpentine path is disposed in adjacent vertical columns viewed from the front of the machine. Other types of vending machine storage racks known in the art may be utilized without departing from the spirit of the present invention.

The front panel 45 is connected to the cabinet 3 at contact points 50. The front panel 45 is disposed adjacent to the edges of the front opening for sealing the interior portion of the cabinet 3. The lower portion of the front panel 45 is connected to a dividing partition 51 which separates the unrefrigerated and refrigerated portions of the cabinet 3. The front panel includes a product selection device 47. The product selection device includes a plurality of selection buttons 52. The front panel also includes a pivotally mounted door 53 over an aperture 49 through which the storage containers are ejected.

The plurality of containers are stored there until a product selection is made causing the vending mechanism 48 to release a container from a selected one of the storage columns 46 and out of the opening 49. Air flow is created in essentially the same manner as with the transparent door storage unit 2.

The invention having been described in detail in connection with the preferred embodiments is to be taken as an example only, not to be restricted thereto. It will be easily understood by those of ordinary skill in the art that other variations and modifications can be easily made within the scope of this invention as defined in the appended claims.

What is claimed is:

1. A refrigerated cabinet for selectively housing a coin-operating vending unit behind a substantially opaque door, or a self-serve product storage unit including product-storage shelves disposed behind a transparent door, said cabinet having an open front wall selectively coverable by one of the opaque or transparent doors and closed top, side and back walls, comprising:

a horizontal partition separating the cabinet into a refrigerated product storage compartment and an unrefrigerated compartment for housing a refrigeration unit, said horizontal partition defining an air intake opening in about the middle thereof and an air outlet opening near said back wall;

a vertical partition in said cabinet spaced from and disposed substantially parallel to the back wall defining an air plenum therebetween, said air plenum being in fluid communication with said outlet opening;

slot means formed in said vertical partition disposed in vertically extending columns, said columns being spaced horizontally across said vertical partition, said slot means directing air streams from said plenum through said storage compartment toward said front wall; and fan means disposed in said bottom compartment for drawing air from the product storage compartment through said air intake opening, into operative engagement with said refrigeration unit and out said air outlet opening into said plenum;

whereby air flows in substantially circular paths up the back wall of the cabinet, toward the front wall and down the front wall into the unrefrigerated compartment.

2. The apparatus of claim 1 further including an additional horizontal partition in the product storage compartment extending from a rear edge thereof connected to the vertical partition near the bottom thereof to a front edge spaced from but closely adjacent to the front wall of the cabinet, said front edge being closer to the front wall than said intake opening in the other horizontal partition.

3. The apparatus of claim 2 further including vertically spaced air deflector baffles disposed in each vertical column of said slot means between each of a plurality of adjacent vertically spaced slots.

4. The apparatus of claim 1 further including vertically spaced air deflector baffles disposed in each vertical column of said slot means between each of a plurality of adjacent vertically spaced slots.

* * * * *